US012097562B2

(12) United States Patent
Kim et al.

(10) Patent No.: US 12,097,562 B2
(45) **Date of Patent: *Sep. 24, 2024**

(54) PREPARATION METHOD FOR METAL FOAM

(71) Applicant: LG CHEM, LTD., Seoul (KR)

(72) Inventors: So Jin Kim, Daejeon (KR); Jong Min Shin, Daejeon (KR); Jin Kyù Lee, Daejeon (KR)

(73) Assignee: LG Chem, LTD., Seoul (KR)

( * ) Notice: Subject to any disclaimer, the term of this patent is extended or adjusted under 35 U.S.C. 154(b) by 21 days.

This patent is subject to a terminal disclaimer.

(21) Appl. No.: 16/610,556

(22) PCT Filed: May 15, 2018

(86) PCT No.: PCT/KR2018/005545

§ 371 (c)(1),
(2) Date: Nov. 4, 2019

(87) PCT Pub. No.: WO2018/212554

PCT Pub. Date: Nov. 22, 2018

(65) Prior Publication Data

US 2021/0154739 A1 May 27, 2021

(30) Foreign Application Priority Data

May 16, 2017 (KR) ..... 10-2017-0060630

(51) Int. Cl.

| | |
|---|---|
| ***B22F 3/11*** | (2006.01) |
| ***B22F 7/00*** | (2006.01) |
| ***B22F 7/04*** | (2006.01) |

(52) U.S. Cl.
CPC ..... *B22F 3/11* (2013.01); *B22F 7/004* (2013.01); *B22F 7/008* (2013.01); *B22F 2007/047* (2013.01); *B22F 2301/10* (2013.01)

(58) Field of Classification Search
CPC ..... B22F 3/11; B22F 3/1103; B22F 3/1109; B22F 3/1115; B22F 3/1118; B22F 3/1121;
(Continued)

(56) References Cited

U.S. PATENT DOCUMENTS 4,064,914 A * 12/1977 Grant ..... B22F 7/002 138/145
5,678,165 A * 10/1997 Wu ..... C04B 38/0006 419/36

(Continued)

FOREIGN PATENT DOCUMENTS

CN 1514756 A 7/2004
CN 102812520 A 12/2012

(Continued)

OTHER PUBLICATIONS

Dhanlal De Lloyd "Standard sieves and Mesh sizes," Chem. Dept, The University of The West Indies, St. Augustine campus (Year: 2004).*

(Continued)

*Primary Examiner* — Samir Shah
*Assistant Examiner* — Sean P. O'Keefe
(74) *Attorney, Agent, or Firm* — Saliwanchik, Lloyd & Eisenschenk

(57) ABSTRACT

Methods for preparing a metal foam are provided. The methods may include forming a metal foam precursor using a slurry that includes metal powder, a dispersant, and a binder and sintering the metal foam precursor.

12 Claims, 2 Drawing Sheets

(58) Field of Classification Search

CPC ..... B22F 3/1125; B22F 3/1137; B22F 3/114; B22F 3/1143; B22F 3/1146; B22F 3/1131; B22F 7/002; B22F 7/006; B22F 2003/1053; B22F 5/006; B22F 1/0074; B22F 2202/05; B22F 2202/06; B22F 2202/07; B22F 2003/1131; B22F 2301/15; B22F 1/107; B22F 3/115; B22F 2003/1106; B22F 2003/1128; B22F 1/10–1/102; B22F 3/22; B22F 7/004; B22F 2007/047; B22F 7/0002; F01N 2330/22; B60B 2360/149; B60B 2255/062; B01D 39/2051; C22C 1/0425; C22C 1/08; C22C 2001/081; C22C 2001/082; C22C 2001/083; C22C 2001/085; C22C 2001/086; C22C 2001/087; C22C 2001/088; C21D 1/10; C21D 1/42; C21D 9/60; H01M 4/762; H01M 4/80; H01M 4/8605; H01M 2004/021; H01M 8/023; H01M 8/0232; H01M 8/0234; H01M 8/0236; H01M 8/0239; H01M 8/0241; H01M 8/0243; H01M 8/0245; H01M 8/1058; H01M 8/106; H01M 8/1062; H01M 8/1067; H01M 8/1079; H01M 50/491

See application file for complete search history.

(56) References Cited

U.S. PATENT DOCUMENTS

| | | | | | |
|---|---|---|---|---|---|
| 5,846,664 | A * | 12/1998 | Third | B22F 7/002 | 428/550 |
| 5,848,351 | A * | 12/1998 | Hoshino | B22F 3/1103 | 428/553 |
| 2007/0048165 | A1* | 3/2007 | Hou | B22F 3/22 | 419/8 |
| 2008/0106853 | A1* | 5/2008 | Suenaga | H01G 9/052 | 428/546 |
| 2009/0232692 | A1* | 9/2009 | Haneji | B22F 3/1137 | 419/2 |
| 2011/0155662 | A1 | 6/2011 | Liu et al. | | |
| 2011/0206944 | A1 | 8/2011 | Uhlenhut et al. | | |
| 2012/0107166 | A1* | 5/2012 | Hoshino | H01M 4/80 | 75/228 |
| 2013/0001774 | A1 | 1/2013 | Masumori et al. | | |
| 2013/0069014 | A1 | 3/2013 | Lee et al. | | |
| 2015/0202838 | A1 | 7/2015 | Jang et al. | | |
| 2017/0021416 | A1* | 1/2017 | Park | B22F 3/1143 | |
| 2017/0025683 | A1* | 1/2017 | Park | B22F 3/10 | |
| 2017/0333992 | A1 | 11/2017 | Gao et al. | | |
| 2017/0348676 | A1* | 12/2017 | Coupland | C04B 35/195 | |

FOREIGN PATENT DOCUMENTS

| | | | | | |
|---|---|---|---|---|---|
| CN | 104588651 | A | | 5/2015 | |
| CN | 105525123 | | | 4/2016 | |
| CN | 105525123 | A | * | 4/2016 | |
| CN | 105648255 | A | | 6/2016 | |
| CN | 105665713 | A | * | 6/2016 | A61M 37/0015 |
| CN | 105854629 | A | * | 8/2016 | |
| CN | 106000123 | A | * | 10/2016 | |
| DE | 102007027837 | A1 | | 12/2008 | |
| EP | 0099337 | A2 | | 1/1984 | |
| EP | 3549700 | | | 10/2019 | |
| JP | S62267402 | | | 11/1987 | |
| JP | S63184265 | A | | 7/1988 | |
| JP | H09306507 | A | | 11/1997 | |
| JP | 10251711 | A | * | 9/1998 | |
| JP | H10251711 | A | | 9/1998 | |
| JP | 2005290493 | | | 10/2005 | |
| JP | 2009102701 | A | * | 5/2009 | |
| JP | 2011170982 | A | | 9/2011 | |
| JP | 5439791 | | | 12/2013 | |
| KR | 100394309 | | | 7/2003 | |
| KR | 1020130061671 | | | 6/2013 | |
| KR | 101343377 | | | 12/2013 | |
| KR | 101355543 | | | 1/2014 | |
| KR | 1020150062611 | | | 6/2015 | |
| KR | 1020180062170 | | | 6/2018 | |
| WO | 2008151614 | A2 | | 12/2008 | |
| WO | 2011114747 | A1 | | 9/2011 | |
| WO | 2016/066140 | | | 5/2016 | |

OTHER PUBLICATIONS

PubChem "Ethanol" (Year: 2015).*

International Search Report corresponding to PCT/KR2018/005545, mailed Aug. 13, 2018 (5 pages included English translation).

Extended European Search Report corresponding to EP 18803244.5, dated Jan. 17, 2020 (7 pages).

Japanese Office Action and English translation corresponding to Japanese Patent Application No. 2019-563469, dated Dec. 14, 2020 (14 pages).

Republic of Korea Office Action and English translation corresponding to Korean Patent Application No. 10-2018-0055426, dated Nov. 25, 2020 (11 pages).

Chinese Decision on Rejection corresponding to CN 201880030356.6; mailed Jun. 29, 2022 (2 pages, English translation of summary only).

Japanese Office Action in corresponding Japanese Patent Application No. JP 2019-563469; dated Mar. 24, 2020 (3 pages, English translation only).

Decision of Rejection issued in corresponding Chinese Application No. 201880030356.6, mailed Jun. 29, 2022.

* cited by examiner

PREPARATION METHOD FOR METAL FOAM

CROSS REFERENCE TO RELATED APPLICATIONS

This application is a 35 U.S.C. § 371 national stage application of PCT International Application No. PCT/KR2018/005545, filed May 15, 2018, which claims priority from Korean Patent Application Nos. 10-2017-0060630, filed May 16, 2017, the contents of which are incorporated herein in their entireties by reference. The above-referenced PCT International Application was published in the Korean language as International Publication No. WO 2018/212554 on Nov. 22, 2018.

TECHNICAL FIELD

The present application relates to a method for preparing a metal foam.

BACKGROUND ART

Metal foams can be applied to various fields including lightweight structures, transportation machines, building materials or energy absorbing devices, and the like by having various and useful properties such as lightweight properties, energy absorbing properties, heat insulating properties, refractoriness or environment-friendliness. In addition, metal foams not only have a high specific surface area, but also can further improve the flow of fluids, such as liquids and gases, or electrons, and thus can also be usefully used by being applied in a substrate for a heat exchanger, a catalyst, a sensor, an actuator, a secondary battery, a gas diffusion layer (GDL) or a microfluidic flow controller, and the like.

DISCLOSURE

Technical Problem

It is one object of the present application to provide a method which can freely control characteristics, such as pore size and porosity, of the metal foam, prepare the metal foam in the form of films or sheets which have conventionally been difficult to produce, particularly the form of thin films or sheets as well, and prepare a metal foam having excellent other physical properties such as mechanical strength.

Technical Solution

Among physical properties mentioned in this specification, when the measured temperature affects relevant physical properties, the physical properties are physical properties measured at room temperature, unless otherwise specified.

In the present application, the term room temperature is a natural temperature without being heated or cooled, which may be, for example, any temperature in a range of 10° C. to 30° C., or a temperature of about 23° C. or about 25° C. or so.

In the present application, the term metal foam or metal skeleton means a porous structure comprising a metal as a main component. Here, the metal as a main component means that the ratio of the metal is 55 wt % or more, 60 wt % or more, 65 wt % or more, 70 wt % or more, 75 wt % or more, 80 wt % or more, 85 wt % or more, 90 wt % or more, or 95 wt % or more based on the total weight of the metal foam or the metal skeleton. The upper limit of the ratio of the metal contained as the main component is not particularly limited. For example, the ratio of the metal may be 100 wt % or less, or less than about 100 wt %.

The term porous property may mean a case where porosity is 30% or more, 40% or more, 50% or more, 60% or more, 70% or more, 75% or more, or 80% or more. The upper limit of the porosity is not particularly limited, and may be, for example, less than about 100%, about 99% or less, or about 98% or less or so. Here, the porosity can be calculated in a known manner by calculating the density of the metal foam or the like.

The method for preparing a metal foam of the present application may comprise a step of sintering a metal foam precursor comprising a metal component. In the present application, the term metal foam precursor means a structure before the process performed to form the metal foam, such as the sintering process, that is, a structure before the metal foam is formed. In addition, even when the metal foam precursor is referred to as a porous metal foam precursor, it is not necessarily porous per se, and may be referred to as a porous metal foam precursor for convenience, if it can finally form a metal foam, which is a porous metal structure.

In the present application, the metal foam precursor may be formed using a slurry containing at least a metal component, a dispersant, and a binder.

Here, as the metal component, metal powder may be applied. An example of the applicable metal powder is determined depending on purposes, which is not particularly limited, but it can be exemplified by any one powder selected from the group consisting of copper powder, molybdenum powder, silver powder, platinum powder, gold powder, aluminum powder, chromium powder, indium powder, tin powder, magnesium powder, phosphorus powder, zinc powder and manganese powder, metal powder mixed with two or more of the foregoing or a powder of an alloy of two or more of the foregoing, without being limited thereto.

If necessary, the metal component may comprise, as an optional component, a metal component having relative magnetic permeability and conductivity in a predetermined range. Such a metal component can be helpful in selecting an induction heating method in a sintering process. However, since the sintering does not necessarily have to proceed by the induction heating method, the metal component having the above magnetic permeability and conductivity is no essential component.

In one example, as the metal powder which can be optionally added, metal powder having relative magnetic permeability of 90 or more may be used. The term relative magnetic permeability ($\mu_r$) is a ratio ($\mu/\mu_0$) of the magnetic permeability ($\mu$) of the relevant material to the magnetic permeability ($\mu_0$) in the vacuum. In another example, the relative magnetic permeability may be 95 or more, 100 or more, 110 or more, 120 or more, 130 or more, 140 or more, 150 or more, 160 or more, 170 or more, 180 or more, 190 or more, 200 or more, 210 or more, 220 or more, 230 or more, 240 or more, 250 or more, 260 or more, 270 or more, 280 or more, 290 or more, 300 or more, 310 or more, 320 or more, 330 or more, 340 or more, 350 or more, 360 or more, 370 or more, 380 or more, 390 or more, 400 or more, 410 or more, 420 or more, 430 or more, 440 or more, 450 or more, 460 or more, 470 or more, 480 or more, 490 or more, 500 or more, 510 or more, 520 or more, 530 or more, 540 or more, 550 or more, 560 or more, 570 or more, 580 or more, or 590 or more. The upper limit of the relative magnetic permeability is not particularly limited because the higher the value is, the more advantageous it is in the case where the induction heating is applied. In one example, the upper limit of the relative magnetic permeability may be, for example, about 300,000 or less.

The metal powder that can be optionally added may also be conductive metal powder. In the present application, the term conductive metal powder may mean a powder of a metal or an alloy thereof having conductivity at 20° C. of about 8 MS/m or more, 9 MS/m or more, 10 MS/m or more, 11 MS/m or more, 12 MS/m or more, 13 MS/m or more, or 14.5 MS/m. The upper limit of the conductivity is not particularly limited, and for example, may be about 30 MS/m or less, 25 MS/m or less, or 20 MS/m or less.

In the present application, the metal powder having the relative magnetic permeability and conductivity may also be simply referred to as conductive magnetic metal powder.

A specific example of such conductive magnetic metal powder can be exemplified by a powder of nickel, iron or cobalt, and the like, but is not limited thereto.

If used, the ratio of the conductive magnetic metal powder in the entire metal powder is not particularly limited. For example, the ratio may be adjusted so that the ratio may generate appropriate Joule heat upon the induction heating. For example, the metal powder may comprise 30 wt % or more of the conductive magnetic metal powder based on the weight of the entire metal powder. In another example, the ratio of the conductive magnetic metal powder in the metal powder may be about 35 wt % or more, about 40 wt % or more, about 45 wt % or more, about 50 wt % or more, about 55 wt % or more, 60 wt % or more, 65 wt % or more, 70 wt % or more, 75 wt % or more, 80 wt % or more, 85 wt % or more, or 90 wt % or more. The upper limit of the conductive magnetic metal powder ratio is not particularly limited, and may be, for example, less than about 100 wt %, or 95 wt % or less. However, the above ratios are exemplary ratios.

The size of the metal powder is also selected in consideration of the desired porosity or pore size, and the like, but is not particularly limited, where the metal powder may have an average particle diameter, for example, in a range of about 0.1 μm to about 200 μm. In another example, the average particle diameter may be about 0.5 μm or more, about 1 μm or more, about 2 μm or more, about 3 μm or more, about 4 μm or more, about 5 μm or more, about 6 μm or more, about 7 μm or more, or about 8 μm or more. In another example, the average particle diameter may be about 150 μm or less, 100 μm or less, 90 μm or less, 80 μm or less, 70 μm or less, 60 μm or less, 50 μm or less, 40 μm or less, 30 μm or less, or 20 μm or less. As the metal in the metal particles, one having different average particle diameters may also be applied. The average particle diameter can be selected from an appropriate range in consideration of the shape of the desired metal foam, for example, the thickness or porosity of the metal foam, and the like.

Here, the average particle diameter of the metal powder may be obtained by a known particle size analysis method, and for example, the average particle diameter may be a so-called D50 particle diameter.

The ratio of the metal component (metal powder) in the slurry as above is not particularly limited, which may be selected in consideration of the desired viscosity and process efficiency. In one example, the ratio of the metal component in the slurry may be 0.5 10 to 95% or so on the basis of weight, but is not limited thereto. In another example, the ratio may be about 1% or more, about 1.5% or more, about 2% or more, about 2.5% or more, about 3% or more, about 5% or more, 10% or more, 15% or more, 20% or more, 25% or more, 30% or more, 35% or more, 40% or more, 45% or more, 50% or more, 55% or more, 60% or more, 65% or more, 70% or more, 75% or more, or 80% or more, or may be about 90% or less, about 85% or less, about 80% or less, about 75% or less, about 70% or less, about 65% or less, 60% or less, 55% or less, 50% or less, 45% or less, 40% or less, 35% or less, 30% or less, 25% or less, 20% or less, 15% or less, 10% or less, or 5% or less, but is not limited thereto.

The metal foam precursor may be formed by using a slurry comprising a dispersant and a binder together with the metal powder.

Here, as the dispersant, for example, an alcohol may be applied. As the alcohol, a monohydric alcohol having 1 to 20 carbon atoms such as methanol, ethanol, propanol, pentanol, octanol, pentanol, 2-methoxyethanol, 2-ethoxyethanol, 2-butoxyethanol, glycerol, texanol, or terpineol, or a dihydric alcohol having 1 to 20 carbon atoms such as ethylene glycol, propylene glycol, hexane diol, octane diol or pentane diol, or a polyhydric alcohol, such as glycerol, etc., may be used, but the kind is not limited to the above.

The slurry may further comprise a binder. The kind of the binder is not particularly limited, and may be appropriately selected depending on the kind of the metal component or the dispersant, and the like applied at the time of producing the slurry. For example, the binder may be exemplified by alkyl cellulose, such as alkyl cellulose having an alkyl group having 1 to 8 carbon atoms such as methyl cellulose or ethyl cellulose, polyalkylene carbonate, such as polyalkylene carbonate having an alkylene unit having 1 to 8 carbon atoms such as polypropylene carbonate or polyethylene carbonate, or a polyvinyl alcohol-based binder (hereinafter, may be referred to as a polyvinyl alcohol compound) such as polyvinyl alcohol or polyvinyl acetate, and the like, but is not limited thereto.

The ratio of each component in the slurry as above is not particularly limited. This ratio can be adjusted in consideration of process efficiency such as coating property and moldability upon a process of using the slurry.

For example, in the slurry, the binder may be included in a ratio of about 1 to 500 parts by weight relative to 100 parts by weight of the above-described metal component. In another example, the ratio may be about 2 parts by weight or more, about 3 parts by weight or more, about 4 parts by weight or more, about 5 parts by weight or more, about 6 parts by weight or more, about 7 parts by weight or more, about 8 parts by weight or more, about 9 parts by weight or more, about 10 parts by weight or more, about 20 parts by weight or more, about 30 parts by weight or more, about 40 parts by weight or more, about 50 parts by weight or more, about 60 parts by weight or more, about 70 parts by weight or more, about 80 parts by weight or more, or about 90 parts by weight or more, about 100 parts by weight or more, about 110 parts by weight or more, about 120 parts by weight or more, about 130 parts by weight or more, about 140 parts by weight or more, about 150 parts by weight or more, about 200 parts by weight or more, or about 250 parts by weight or more, and may be about 450 parts by weight or less, about 400 parts by weight or less, about 350 parts by weight or less, about 300 parts by weight or less, about 250 parts by weight or less, about 200 parts by weight or less, about 150 parts by weight or less, about 100 parts by weight or less, about 50 parts by weight or less, about 40 parts by weight or less, about 30 parts by weight or less, about 20 parts by weight or less, or about 10 parts by weight or less.

In the slurry, the dispersant may be contained at a ratio of about 10 to 2,000 parts by weight relative to 100 parts by weight of the binder. In another example, the ratio may be about 20 parts by weight or more, about 30 parts by weight or more, about 40 parts by weight or more, about 50 parts by weight or more, about 60 parts by weight or more, about 70 parts by weight or more, about 80 parts by weight or more, about 90 parts by weight or more, about 100 parts by weight or more, about 200 parts by weight or more, about 300 parts by weight or more, about 400 parts by weight or more, about 500 parts by weight or more, about 550 parts by weight or more, about 600 parts by weight or more, or about 650 parts by weight, and may be about 1,800 parts by weight or less, about 1,600 parts by weight or less, about 1,400 parts by weight or less, about 1,200 parts by weight or less, or about 1,000 parts by weight or less.

In this specification, the unit part by weight means a weight ratio between the respective components, unless otherwise specified.

The slurry may further comprise a solvent, if necessary. However, according to one example of the present application, the slurry may not contain the solvent. As the solvent, an appropriate solvent may be used in consideration of solubility of the slurry component, for example, the metal component or the binder, and the like. For example, as the solvent, those having a dielectric constant within a range of about 10 to 120 can be used. In another example, the dielectric constant may be about 20 or more, about 30 or more, about 40 or more, about 50 or more, about 60 or more, or about 70 or more, or may be about 110 or less, about 100 or less, or about 90 or less. Such a solvent may be exemplified by water, an alcohol having 1 to 8 carbon atoms such as ethanol, butanol or methanol, DMSO (dimethyl sulfoxide), DMF (dimethyl formamide) or NMP (N-methylpyrrolidinone), and the like, but is not limited thereto.

When a solvent is applied, it may be present in the slurry at a ratio of about 50 to 400 parts by weight relative to 100 parts by weight of the binder, but is not limited thereto. In another example, the ratio of the solvent may be about 60 parts by weight or more, about 70 parts by weight or more, about 80 parts by weight or more, about 90 parts by weight or more, about 100 parts by weight or more, about 110 parts by weight or more, about 120 parts by weight or more, about 130 parts by weight or more, about 140 parts by weight or more, about 150 parts by weight or more, about 160 parts by weight or more, about 170 parts by weight or more, about 180 parts by weight or more, or about 190 parts by weight or more, or may be 300 parts by weight or less, or 250 parts by weight or less, but is not limited thereto.

The slurry may also comprise, in addition to the above-mentioned components, known additives which are additionally required. However, the process of the present application may be performed using a slurry comprising no blowing agent among known additives.

The method of forming the metal foam precursor using the slurry as above is not particularly limited. In the field of producing metal foams, various methods for forming the metal foam precursor are known, and in the present application all of these methods can be applied. For example, the metal foam precursor may be formed by holding the slurry in an appropriate template, or by coating the slurry in an appropriate manner.

It may be advantageous to apply a coating process when producing metal foams in the form of films or sheets according to one example of the present application, especially when producing metal foams in the form of thin films or sheets. For example, the desired metal foam may be formed by coating the slurry on a suitable base material to form a precursor, followed by the sintering process to be described below.

The shape of such a metal foam precursor is not particularly limited as it is determined depending on the desired metal foam. In one example, the metal foam precursor may be in the form of a film or sheet. For example, when the precursor is in the form of a film or sheet, the thickness may be 2,000 μm or less, 1,500 μm or less, 1,000 μm or less, 900 μm or less, 800 μm or less, 700 μm or less, 600 μm or less, 500 μm or less, 400 μm or less, 300 μm or less, 200 μm or less, 150 μm or less, about 100 μm or less, about 90 μm or less, about 80 μm or less, about 70 μm or less, about 60 μm or less, or about 55 μm or less. Metal foams have generally brittle characteristics due to their porous structural features, so that there are problems that they are difficult to be produced in the form of films or sheets, particularly thin films or sheets, and are easily broken even when they are made. However, according to the method of the present application, it is possible to form a metal foam having pores uniformly formed inside and excellent mechanical properties as well as a thin thickness.

Here, the lower limit of the precursor thickness is not particularly limited. For example, the film or sheet shaped precursor may have a thickness of about 5 μm or more, 10 μm or more, or about 15 μm or more.

If necessary, a suitable drying process may also be performed during a process of forming the metal foam precursor. For example, the metal foam precursor may also be formed by forming the slurry by the above-described coating method or the like and then drying it constant time. The conditions of the drying are not particularly limited and can be controlled, for example, at a level where the solvent contained in the slurry can be removed to a desired level. For example, the drying may be performed by maintaining the formed slurry at a temperature in a range of about 50° C. to 250° C., about 70° C. to 180° C., or about 90° C. to 150° C. for an appropriate time. The drying time can also be selected in an appropriate range.

In one example, the metal foam precursor may be formed on a metal substrate. For example, the metal foam precursor may be formed by coating the above-described slurry on a metal substrate, and if necessary, through the above-described drying process. Depending on the application of the metal foam, it may be necessary to form the metal foam on a metal base material (substrate). Therefore, conventionally, the metal foam has been attached on a metal base material to form the above structure. However, this method has difficulty in securing adhesion between the metal foam and the metal base material, and particularly, it has had difficulty in attaching a thin metal foam on the metal base material. However, according to the method disclosed in the present application, even in the case of a metal foam having a thin thickness, it can be formed on a metal base material with good adhesive force.

The type of the metal base material is determined depending on purposes, which is not particularly limited, and for example, a base material of the same metal as or the different metal from the metal foam can be applied.

For example, the metal base material may be a base material of any one metal selected from the group consisting of copper, molybdenum, silver, platinum, gold, aluminum, chromium, indium, tin, magnesium, phosphorus, zinc and manganese, or a base material of a mixture or an alloy of two or more thereof, and if necessary, a base material of any one selected from the group consisting of nickel, iron and cobalt, which are the above-described conductive magnetic metals, or a mixture or alloy of two or more thereof, or a base material of a mixture or alloy of the conductive magnetic metal and the above other metals, and the like may also be used.

The thickness of such a metal base material is not particularly limited, which may be suitably selected depending on purposes.

The metal foam can be prepared by sintering the metal foam precursor formed in the above manner. In this case, a method of performing the sintering for producing the metal foam is not particularly limited, and a known sintering method can be applied. That is, the sintering can proceed by a method of applying an appropriate amount of heat to the metal foam precursor in an appropriate manner.

In this case, the conditions of the sintering may be controlled, in consideration of the state of the applied metal precursor, for example, the kind and amount of the metal powder, or the kind and amount of the binder or dispersant, and the like, such that while the metal powder is connected to form the porous structure, the binder and the dispersant, and the like may be removed, where the specific conditions are not particularly limited.

For example, the sintering can be performed by maintaining the precursor at a temperature in a range of about 500° C. to 2000° C., in a range of 700° C. to 1500° C., or in a range of 800° C. to 1200° C., and the holding time may also be selected optionally. In one example, the holding time may be in a range of about 1 minute to 10 hours, but is not limited thereto.

That is, as described above, the sintering may be controlled, in consideration of the state of the applied metal precursor, for example, the kind and amount of the metal powder, or the kind and amount of the binder or dispersant, and the like, such that while the metal powder is connected to form the porous structure, the binder and the dispersant, and the like may be removed.

The present application also relates to a metal foam. The metal foam may be one produced by the above-described method. In one example, such a metal foam may be in the form of being attached on the above-described metal base material or substrate. FIG. 1 is a diagram showing an example of the metal foam (10) as above, in which a porous metal structure (12), which is a metal foam, is formed on a metal base material (11).

The metal foam may have porosity in a range of about 40% to 99%. As mentioned above, according to the method of the present application, porosity and mechanical strength can be controlled, while comprising uniformly formed pores. The porosity may be 50% or more, 60% or more, 70% or more, 75% or more, or 80% or more, or may be 95% or less, or 90% or less.

The metal foam may also be present in the form of thin films or sheets. In one example, the metal foam may be in the form of a film or sheet. The metal foam of such a film or sheet form may have a thickness of 2,000 μm or less, 1,500 μm or less, 1,000 μm or less, 900 μm or less, 800 μm or less, 700 μm or less, 600 μm or less, 500 μm or less, 400 μm or less, 300 μm or less, 200 μm or less, 150 μm or less, about 100 μm or less, about 90 μm or less, about 80 μm or less, about 70 μm or less, about 60 μm or less, or about 55 μm or less. For example, the film or sheet shaped metal foam may have a thickness of about 10 μm or more, about 20 μm or more, about 30 μm or more, about 40 μm or more, about 50 μm or more, about 100 μm or more, about 150 μm or more, about 200 μm or more, about 250 μm or more, about 300 μm or more, about 350 μm or more, about 400 μm or more, about 450 μm or more, or about 500 μm or more.

The metal foam may have excellent mechanical strength, and for example, may have tensile strength of 2.5 MPa or more, 3 MPa or more, 3.5 MPa or more, 4 MPa or more, 4.5 MPa or more, or 5 MPa or more. Also, the tensile strength may be about 10 MPa or more, about 9 MPa or less, about 8 MPa or less, about 7 MPa or less, or about 6 MPa or less. Such tensile strength can be measured, for example, by KS B 5521 at room temperature.

Such metal foams can be utilized in various applications where a porous metal precursor is required. In particular, according to the method of the present application, it is possible to produce a thin film or sheet shaped metal foam having excellent mechanical strength as well as the desired level of porosity, as described above, thus expanding applications of the metal foam as compared to the conventional metal foam.

Examples of metal foams that can be applied include machine tool saddles, heat dissipation materials, sound absorbing materials, heat insulating materials, heat exchangers, heat sinks, dustproof materials, battery materials such as electrodes, and the like, but are not limited thereto.

Advantageous Effects

The present application provides a method which can freely control characteristics, such as pore size and porosity, of the metal foam, prepare the metal foam in the form of films or sheets which have conventionally been difficult to produce, particularly the form of thin films or sheets as well, and prepare a metal foam having excellent other physical properties such as mechanical strength. According to one example of the present application, it is possible to efficiently form a structure in which such a metal foam is integrated on a metal base material with good adhesive force.

MODE FOR INVENTION

Hereinafter, the present application will be described in detail by way of examples and comparative examples, but the scope of the present application is not limited to the following examples.

Example 1

Copper (Cu) powder having an average particle diameter (D50 particle diameter) of about 10 to 20 μm was used as a metal component. The copper powder was mixed with a mixture in which ethylene glycol (EG) as a dispersant and ethyl cellulose (EC) as a binder were mixed in a weight ratio (EG:EC) of 4:5, so that the weight ratio (Cu:EC) of the copper powder to the binder was about 10:1, thereby preparing a slurry. The slurry was coated in the form of a film and dried at about 120° C. for about 1 hour to form a metal foam precursor. At this time, the thickness of the coated metal foam precursor was about 300 The sintering was performed to prepare copper foam by applying an external heat source in an electric furnace so that the precursor was maintained at a temperature of about 1000° C. in a hydrogen/argon gas atmosphere for 2 hours. The porosity of the prepared sheet-shaped copper foam was about 65%.

Example 2

Copper (Cu) powder having an average particle diameter (D50 particle diameter) of about 10 to 20 μm was used as a metal component. The copper powder was mixed with a mixture in which Texanol as a dispersant and ethyl cellulose (EC) as a binder were mixed in a weight ratio (Texanol:EC) of 4:5, so that the weight ratio (Cu:EC) of the copper powder to the binder was about 10:1, thereby preparing a slurry. The slurry was coated in the form of a film and dried at about 120° C. for about 1 hour to form a metal foam precursor. At this time, the thickness of the coated metal foam precursor was about 300 μm. The sintering was performed to prepare copper foam by applying an external heat source in an electric furnace so that the precursor was maintained at a temperature of about 1000° C. in a hydrogen/argon gas atmosphere for 2 hours. The porosity of the prepared sheet-shaped copper foam was about 62%.

Example 3

Figure 1:
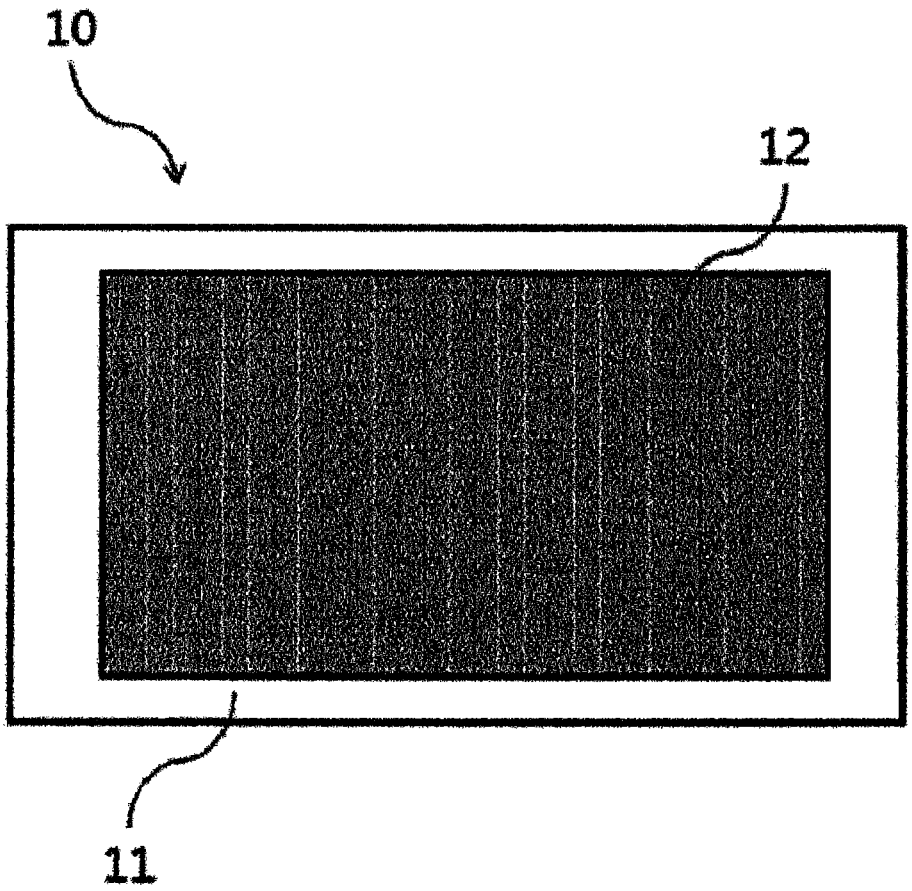
FIG. 1 is a diagram showing the form of an exemplary metal foam of the present application.
Figure 2:
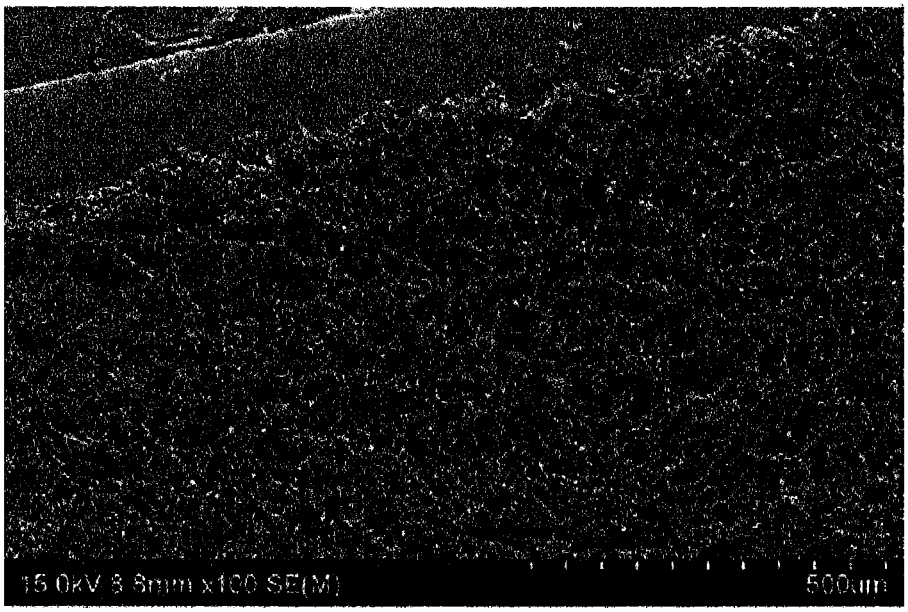
FIG. 2 is a SEM photograph of the metal foam formed in an example.

A slurry was prepared in the same manner as in Example 1, except that terpineol was used instead of ethylene glycol as a dispersant and polyvinyl acetate (PVAc) was used instead of ethyl cellulose (EC) as a binder. Upon preparing the slurry, the formulation ratio of the copper powder, the dispersant and the polyvinyl acetate was 1:1:0.1 (Cu: terpineol: PVAc) on the basis of weight. The slurry was coated on a copper base material to a thickness of about 30 μm in a film shape and dried in the same manner as in Example 1 to form a metal foam precursor on the copper base material. Subsequently, the sintering was performed under the same conditions as in Example 1 to form the copper foam integrated with the copper base material. The porosity of the prepared copper foam was about 68%, which was integrated with the copper substrate with excellent adhesion. FIG. 2 is a SEM photograph of the structure thus formed.

What is claimed is:

1. A method for preparing a metal foam, the method comprising:

forming a metal foam precursor on a metal base material by coating the metal base material with a slurry and drying; and sintering the metal foam precursor to form the metal foam, thereby adhering the metal foam to the metal base material, wherein the drying is performed at a temperature in a range of 50° C. to 250° C., wherein the slurry consists of metal powder, a dispersant and a binder, wherein the slurry does not comprise water, wherein the slurry consists of 1 to 500 parts by weight of the binder relative to 100 parts by weight of the metal powder and 10 to 1,600 parts by weight of the dispersant relative to 100 parts by weight of the binder, wherein the dispersant is at least one selected from the group consisting of pentanol, octanol, 2-methoxyethanol, 2-ethoxyethanol, 2-butoxyethanol, texanol, terpineol, dihydric alcohol and polyhydric alcohol, and wherein the prepared metal foam has a porosity of 60% or more.

2. The method for preparing the metal foam according to claim 1, wherein the slurry consists of 7 to 500 parts by weight of the binder relative to 100 parts by weight of the metal powder and 10 to 1,400 parts by weight of the dispersant relative to 100 parts by weight of the binder.

3. The method for preparing the metal foam according to claim 1, wherein the metal powder comprises copper powder.

4. The method for preparing the metal foam according to claim 1, wherein the metal powder has an average particle diameter in a range of 0.1 μm to 30 μm.

5. The method for preparing the metal foam according to claim 1, wherein the binder is alkyl cellulose, polyalkylene carbonate or a polyvinyl alcohol-based binder.

6. The method for preparing the metal foam according to claim 1, wherein the dispersant is at least one selected from the group consisting of texanol, terpineol, dihydric alcohol and polyhydric alcohol.

7. The method for preparing the metal foam according to claim 1, wherein the metal base material is a base material of any one metal selected from the group consisting of copper, molybdenum, silver, platinum, gold, aluminum, chromium, indium, tin, magnesium, zinc, nickel, iron, cobalt and manganese, or a base material of a mixture or alloy of two or more selected from the group of metals.

8. The method for preparing the metal foam according to claim 7, wherein the metal powder comprises copper powder, and the metal base material comprises copper.

9. The method for preparing the metal foam according to claim 8, wherein the sintering is performed at 1000° C. for 2 hours.

10. The method for preparing the metal foam according to claim 1, wherein the sintering is performed at a temperature in a range of 500° C. to 2000° C.

11. The method for preparing the metal foam according to claim 1, wherein the sintering is performed by induction heating.

12. The method for preparing the metal foam according to claim 1, wherein the metal foam precursor is sintered in an atmosphere including hydrogen and argon.

* * * * *